US009260891B2

(12) United States Patent
Treadwell

(10) Patent No.: US 9,260,891 B2
(45) Date of Patent: Feb. 16, 2016

(54) CONTAINER WITH GRAVITY RELEASABLE LOCKING LIDS

(71) Applicant: Myers Industries, Inc., Akron, OH (US)

(72) Inventor: Simon Treadwell, Toronto (CA)

(73) Assignee: Myers Industries, Inc., Akron, OH (US)

( * ) Notice: Subject to any disclaimer, the term of this patent is extended or adjusted under 35 U.S.C. 154(b) by 0 days.

(21) Appl. No.: 14/565,929

(22) Filed: Dec. 10, 2014

(65) Prior Publication Data

US 2015/0159404 A1 Jun. 11, 2015

Related U.S. Application Data

(60) Provisional application No. 62/046,720, filed on Sep. 5, 2014, provisional application No. 61/914,093, filed on Dec. 10, 2013.

(51) Int. Cl.

| | |
|---|---|
| ***B65F 1/16*** | (2006.01) |
| ***B65D 25/28*** | (2006.01) |
| ***B65D 55/10*** | (2006.01) |
| ***E05B 65/52*** | (2006.01) |
| ***B65F 1/14*** | (2006.01) |

(52) U.S. Cl.

CPC ..... *E05B 65/5292* (2013.01); *B65D 25/2802* (2013.01); *B65D 55/10* (2013.01); *B65F 1/1615* (2013.01)

(58) Field of Classification Search

CPC .... B65D 25/2802; B65D 55/10; B65D 55/02; B65D 25/28; B65F 1/1615; B65F 1/16; B65F 1/14; B65F 1/1646; E05B 65/5292

USPC ..... 220/318, 828, 827, 810, 212.5, 212, 220/495.06, 908, 324, 315, 264, 263, 262, 220/260

See application file for complete search history.

(56) References Cited

U.S. PATENT DOCUMENTS 2,941,682 A * 6/1960 Keys ..... 414/414
2,943,754 A * 7/1960 Keys ..... 414/424

* cited by examiner

*Primary Examiner* — Robert J Hicks
(74) *Attorney, Agent, or Firm* — Benesch, Friedlander, Coplan & Aronoff, LLP

(57) ABSTRACT

A container can include a body having an opening, a lid for selectively covering the opening, and a lock system for securing the lid. The lock system can include a limiter slidably mounted on a pivot pin between first and second latch members and configured to engage and control rotation of the first and second latch members. The limiter can be weighted such that when the container is upright the limiter is biased by gravity towards a pivot pin when the first and second latch members engage a lock pin and prevent the first and second latch members from disengaging the lock pin.

7 Claims, 11 Drawing Sheets

CONTAINER WITH GRAVITY RELEASABLE LOCKING LIDS

RELATED APPLICATIONS

This application claims priority to U.S. Prov. Application No. 62/046,720, filed on Sep. 5, 2014, and U.S. Prov. Appln. No. 61/914,093, filed on Dec. 10, 2013, both of which are entitled "Containers with Gravity Releasable Locking Lids" and are incorporated herein by reference.

TECHNICAL FIELD

The present disclosure relates to containers such as waste or compost bins. In particular, the present disclosure provides containers with lids that automatically lock when closed to inhibit access by pests, and open when tipped upside down to facilitate dumping into collection vehicles.

BACKGROUND

When containers such as trash or compost bins contain food scraps, animals may be attracted and try to gain access to the container. Accordingly, it is desirable to provide such containers with lockable lids to inhibit access by animals. However, such containers must also be readily openable for filling by users and automatically open for dumping by automated waste collection.

The inventors have determined a need for improved containers with lockable lids.

SUMMARY

One aspect provides a container comprising a body having a wall defining an interior and an opening to the interior at a top of the body; a lid pivotally coupled to a top of the body for selectively covering the opening; and a lock system for selectively securing the lid to the container. The lock system comprises a pivot pin mounted to the lid; a lock pin mounted on the body adjacent to the opening and generally vertically aligned with the pivot pin when the container is upright; a first latch member pivotally mounted on the pivot pin and configured to engage the lock pin from a first side thereof; a second latch member pivotally mounted on the pivot pin and configured to engage the lock pin from a second side thereof opposite the first side; and a limiter slidably mounted on the pivot pin between the first and second latch members and configured to engage and control the rotation of the first and second latch members, the limiter weighted such that when the container is upright the limiter is biased by gravity towards the pivot pin when the first and second latch members engage the lock pin to prevent the first and second latch members from disengaging the lock pin. Each of the first and second latch members comprise a latch body having a recess sized to receive the lock pin to prevent opening of the lid when the latch members engage the lock pin, and a bottom surface shaped to pivot the latch member away from the lock pin when the latch body contacts the lock pin as the lid closes.

The pivot pin and the lock pin may be oriented along a front-back direction with respect to the container, such that a critical angle past horizontal at which gravity pulls the limiter away allowing latch members to rotate out of engagement with the lock pin is lesser for forward or backward tilting as compared to leftward or rightward tipping.

The container may comprise a handle assembly operable to selectively disengage the latch members from the lock pin, wherein the latch members are free to rotate about the pivot pin independent of the handle assembly.

The handle assembly may comprise a grip on a top of the lid, the grip pivotally connected to the lid, and a pair of arms connected to the grip, the arms located on an underside of the lid, wherein each of the latch members further comprises a protrusion extending outwardly and configured to be lifted by one of the arms when the grip of the handle assembly is lifted by a user, such that the latch members are pivoted out of engagement with the lock pin when the grip is lifted. In some embodiments, a connecting bar may extend between the ends of the arms, and the connecting bar may be configured to lift the limiter when the grip is lifted.

The handle assembly may further comprise a dual action lock mechanism comprising a first fastener connected to the handle assembly; and a second fastener connected to the lid, wherein the first fastener and the second fastener are generally vertically aligned and designed to engage one another, and when engaged, prevent lifting of the handle assembly.

The handle assembly may comprise a pair of grips on a top of the lid, the grips pivotally connected to the lid, each grip of the pair having a flange coupled thereto configured to engage one of the latch members, such that the latch members are pivoted out of engagement with the lock pin when the grips are squeezed together.

The container may further comprise a safety release accessible from the interior of the container, the safety release comprising a pulling member coupled to the underside of the lid, and at least one string, cable, cord, wire or other connecting member connecting the pulling member to the latch members or the handle assembly.

Further aspects and details of example embodiments are set forth below.

DRAWINGS

The following figures set forth embodiments in which like reference numerals denote like parts. Embodiments are illustrated by way of example and not by way of limitation in the accompanying figures.

DETAILED DESCRIPTION

Figure 1:
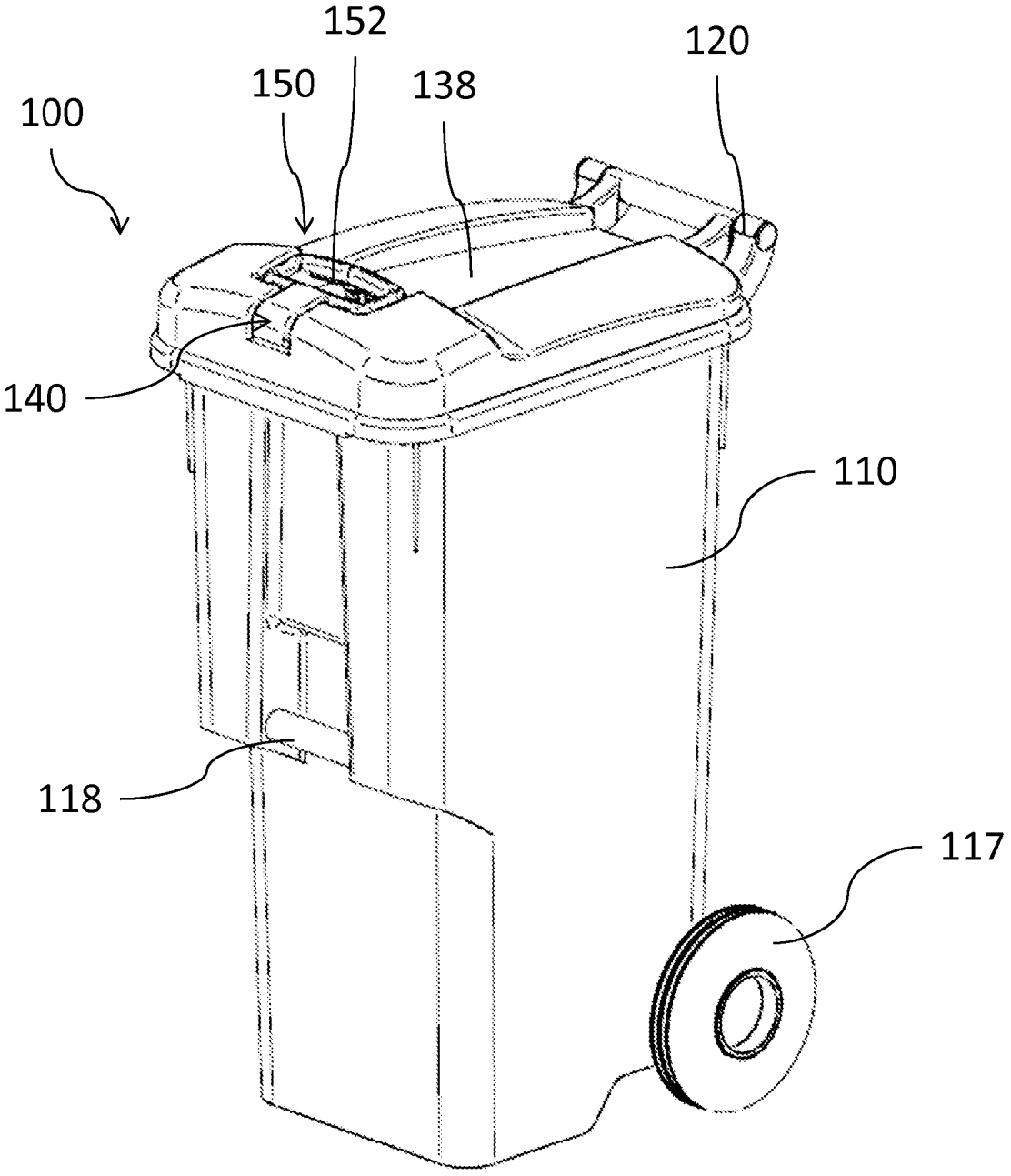
FIG. 1 is a perspective view of a container according to one embodiment.

The following describes example containers with gravity releasable locking lids according to particular embodiments. The example containers disclosed herein are in the form of municipal composting bins with a standard size and shape. As one skilled in the art will appreciate, in other embodiments the containers may have different sizes and shapes.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Figure 2:
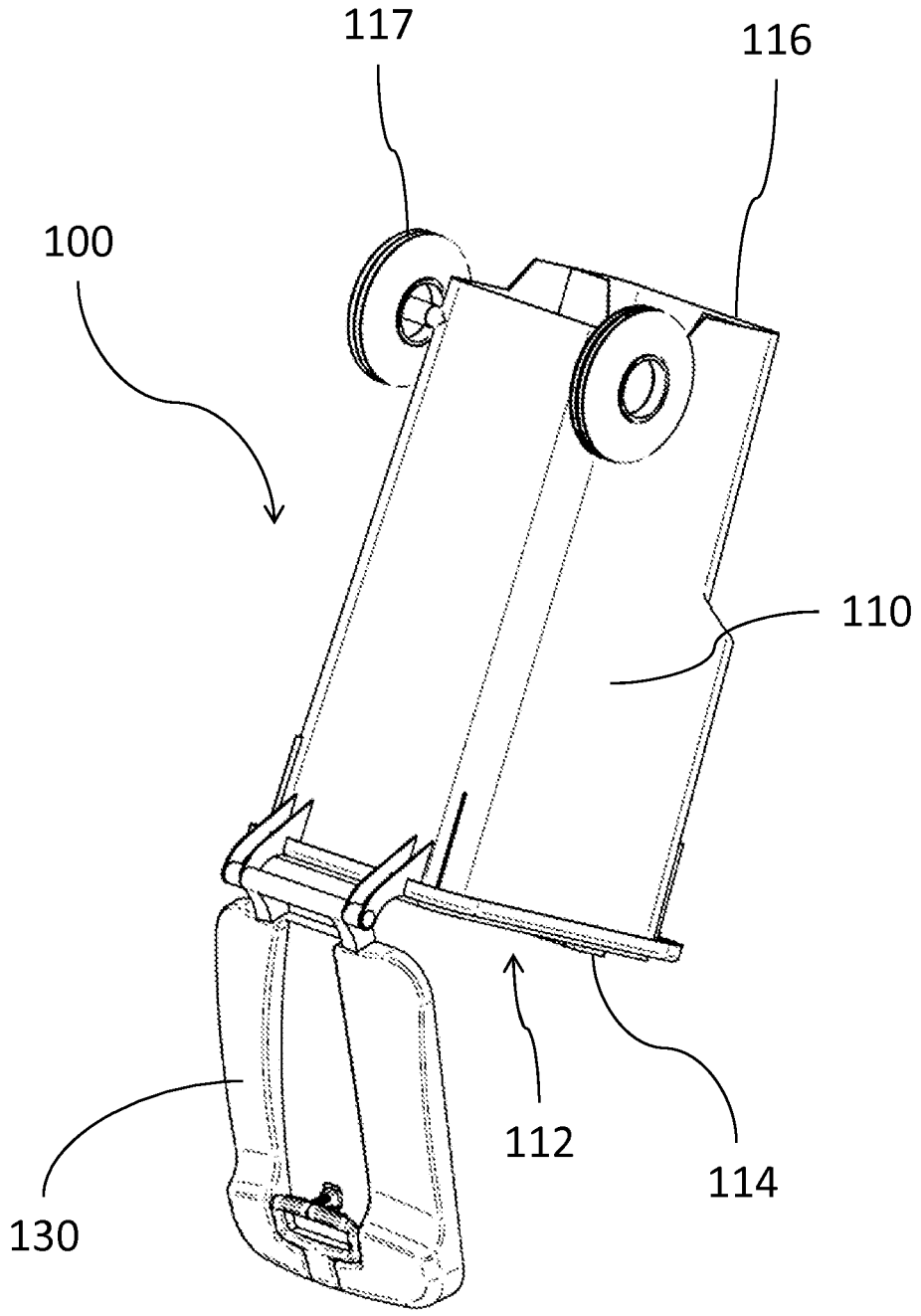
FIG. 2 is a perspective view of the container of FIG. 1 tipped forward past horizontal for dumping.

FIG. 1 shows an example container 100 according to one embodiment. The container 100 comprises a body 110 and a lid 130 connected by a hinge 120. The body 110 has an interior for holding trash, composting material, or the like, which is accessible through an opening 112 (as shown in FIG. 2). The lid 130 is pivotable about the hinge 120 to selectively open and close the opening 112. As discussed further below, the lid 130 is held in the closed position by a lock system 140, and the lock system 140 is configured to release and allow the lid 130 to swing open when the container 100 is tipped for dumping, as shown in FIG. 2.

Figure 3:
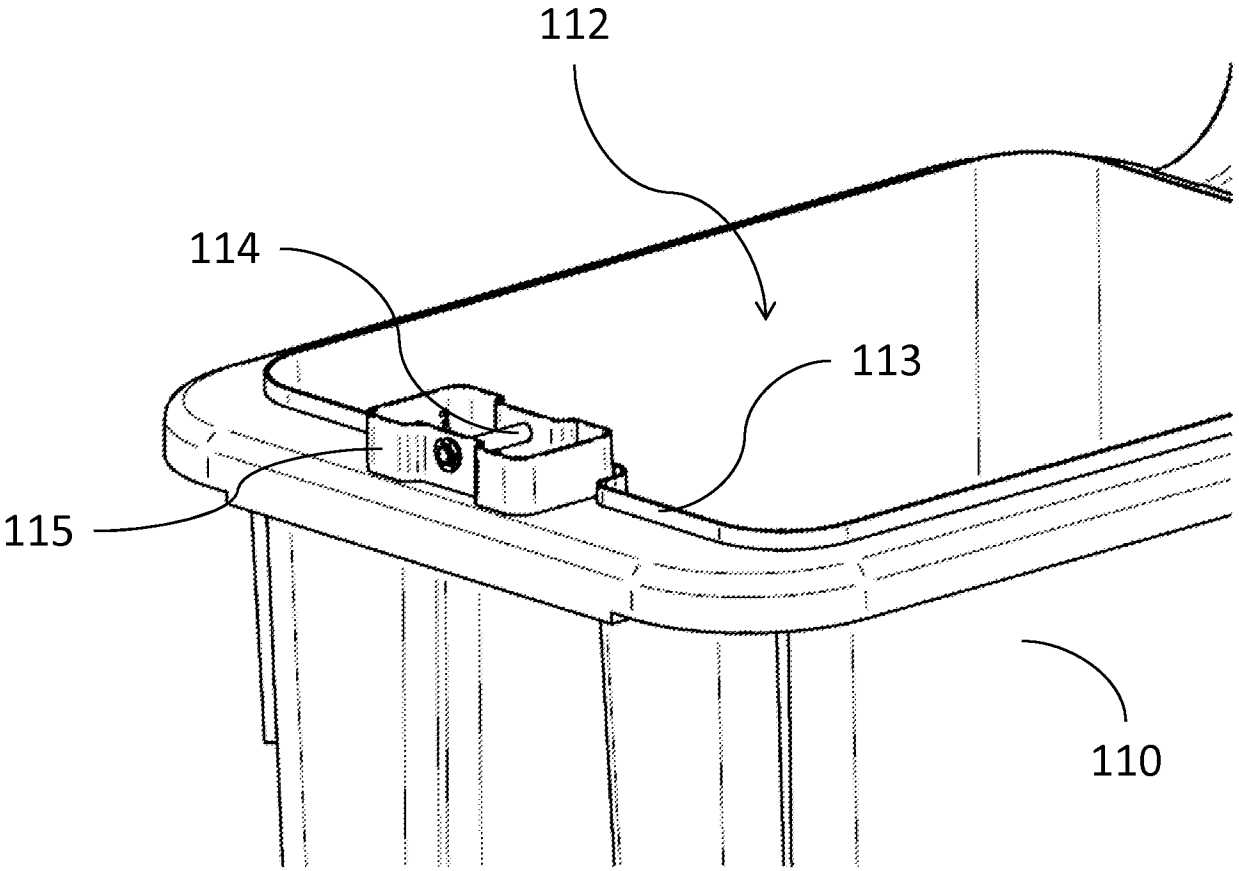
FIG. 3 is a perspective view of the container body of FIG. 1.

The body 110 has a base 116 which rests on the ground when the container 100 is upright, and wheels 117 to facilitate moving the container 100 by hand. A grip 118 may be provided on the front face of the container 100. As shown in FIG. 3, a lip 113 is optionally provided around the edge of the opening 112.

Referring now to FIG. 3, a lock pin 114 is mounted on the body 110 adjacent to the opening, as described further below. The lock pin 114 may be supported by flanges (not shown) extending upwardly from the body. In another embodiment, the lock pin 114 may be mounted within a collar 115 that protrudes from the upper surface of the body 110. The lock pin 114 and collar 115 may be integrally formed with the body 110 in some embodiments. In other embodiments the lock pin 114 and/or the collar 115 may be separate elements attached to the body 110, or the lock pin 114 may be supported by other means.

Figure 4:
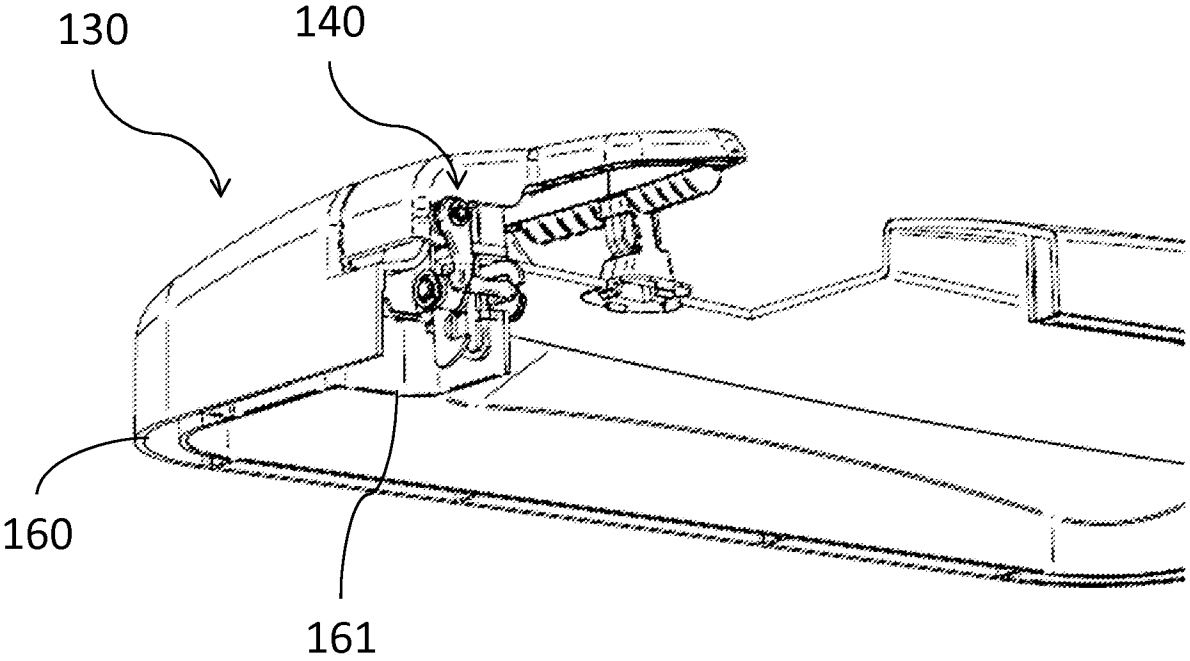
FIG. 4 is a perspective view of the lid of the container of FIG. 1 with a portion of the lid cut away to show features of one embodiment of a lock system.

When the container 100 is in a closed position, the collar 115 is surrounded by an outer wall 160 and inner wall 161 of the lid 130. As shown in FIG. 4, the outer wall 160 and inner wall 161 of the lid 130 are shaped to fit around the collar 115 (shown in FIG. 3) to prevent movement of the lid 130 with respect to the body 110. This configuration also prevents the locking mechanism 140 from being loaded if the container 100 were to fall to one side or another.

Figure 5:
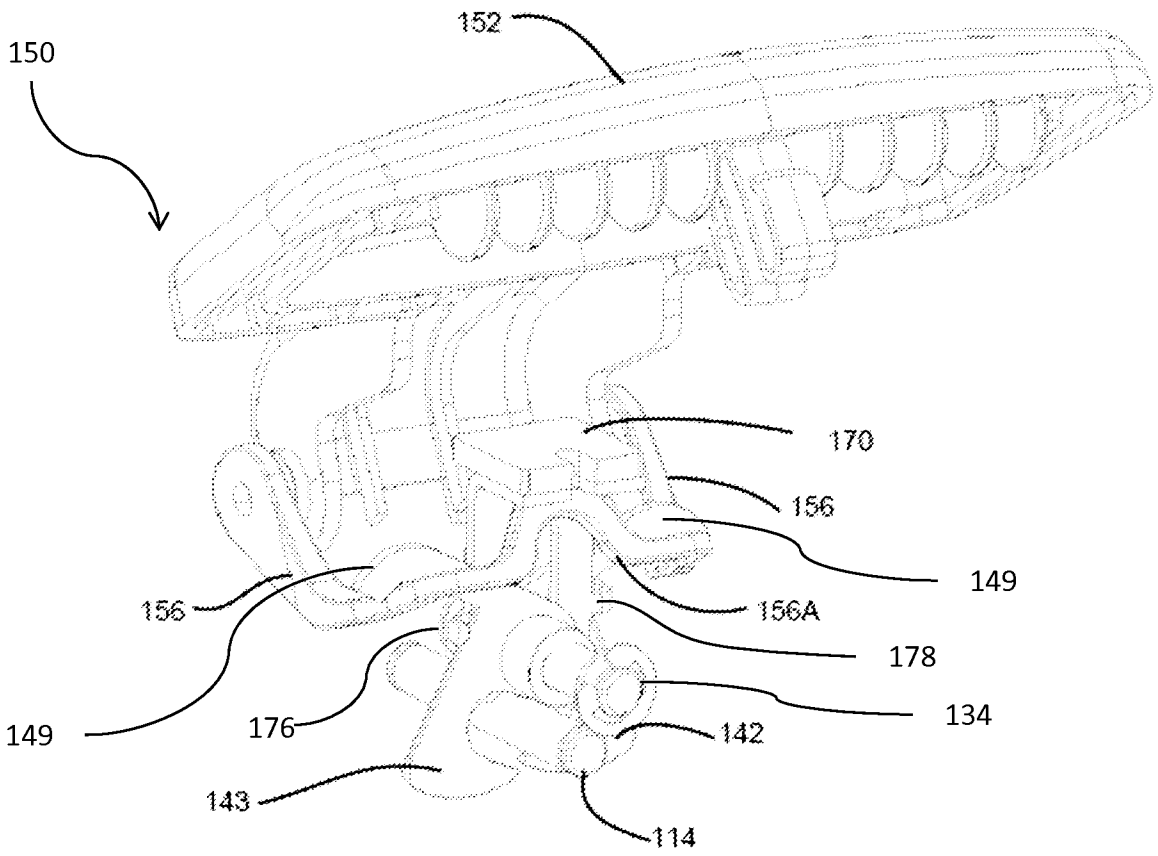
FIG. 5 is a perspective view of the lock system of the container of FIG. 1 with the container body and lid removed to show the individual components.

As shown in FIG. 5, which is a depiction of the handle assembly 150 on the lid 130 that has been closed around the lock pin 114 of the body (not shown), the lock system 140 includes a pivot pin 134 disposed on the underside of the lid 130. The pivot pin 134 is generally vertically aligned with the lock pin 114. In one embodiment, the lid 130 includes lid mounts (not shown) that may be molded or adhered to the underside of the lid. The pivot pin 134 may be inserted into the lid mounts and retained in a slot that machined into either end of the pivot pin 134 or by an E clip inserted into the slot. It should be appreciated by a person of skill in the art that the pivot pin may be adhered or connected to the lid other ways.

As shown in FIGS. 6-10, the lock pin 114 and the pivot pin 134 are oriented along a generally front/back direction with respect to the container 100 (with the back of the container 100 being the side where the hinge 120 is located, and the front of the container being the opposing side). In other embodiments, the lock pin 114 and the pivot pin 134 may be differently oriented, for example along a generally left/right direction as discussed below with reference to FIGS. 12-14. In some embodiments, multiple lock systems may be provided, with the lock and pivot pins of different lock systems oriented along different directions.

While the container 100 is upright, the lid 130 is held in the closed position shown in FIG. 1 by a lock system 140. The container 100 may be picked up by a mechanical arm or the like attached to a collection vehicle, and the arm tips the container 100 to dump its contents into the vehicle. The lock system 140 is configured to automatically release when tipped for dumping, as described further below.

In one embodiment, a handle assembly 150 is provided to manually release the lock system 140. The handle assembly 150 may be operated by a single hand, as described further below, while still inhibiting access by raccoons or other animals that may be attracted to the contents of the container 100.

Figure 6:
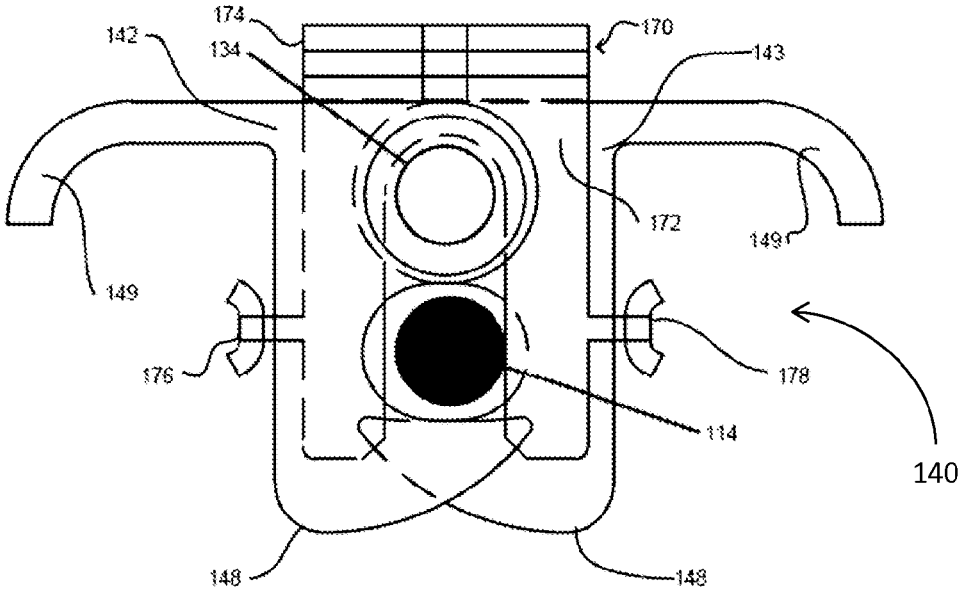
FIG. 6 shows the latch members and the limiter of the lock system of FIGS. 4 and 5 when the container is in an upright position.
Figure 7:
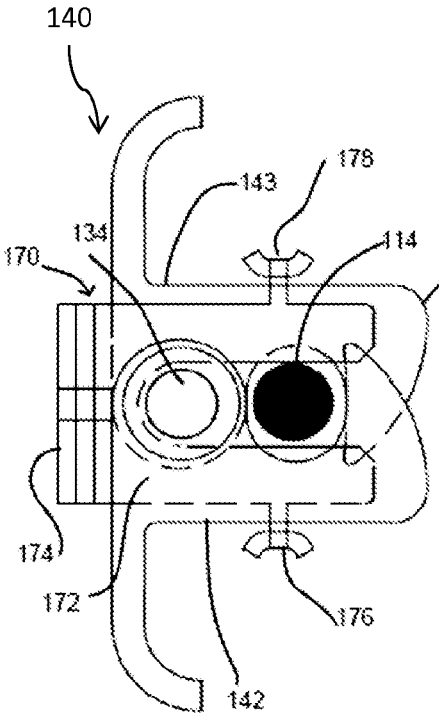
FIG. 7 shows the latch members and the limiter of the lock system of FIGS. 4 and 5 when the container is in a sideways position.
Figure 8:
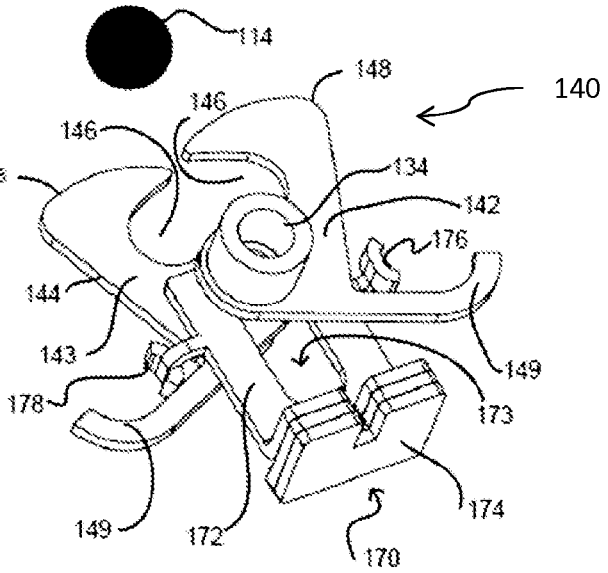
FIG. 8 shows the latch members and the limiter of the lock system of FIGS. 4 and 5 when the container is in an inverted position.

As seen in FIGS. 6-8, which depict an isolated lock mechanism 140 on the lid and lock pin 114 on the body, the lock system 140 comprises first and second latch members 142 and 143 pivotally mounted on the pivot pin 134 on the underside of the lid 130 (not shown), and a limiter 170 slidably mounted on the pivot pin 134 between the first and second latch members 142 and 143. The first latch member 142 is pivotable to engage the lock pin 114 on the body 110 from a first side thereof. The second latch member 143 is pivotable to engage the lock pin 114 from a second side thereof. The limiter 170 is configured to engage and control the rotation of the first and second latch members 142 and 143, as discussed further below.

As shown in FIGS. 5 to 9, each of the first and second latch members 142 and 143 comprises a latch body 144 having a recess 146 (as shown in FIG. 8) configured to engage the lock pin 114. The latch body 144 also has a bottom surface 148 shaped to pivot the latch member outwardly upon contact with the lock pin 114 when the lid closes. Each latch member 142/143 also has a hook-like protrusion 149 configured to allow the latch members 142 and 143 to be disengaged from the lock pin 114 by operation of the handle assembly 150, as discussed below. The latch members 142 and 143 may be substantially the same, but mounted in opposite directions on the pivot pin 134.

Figure 9:
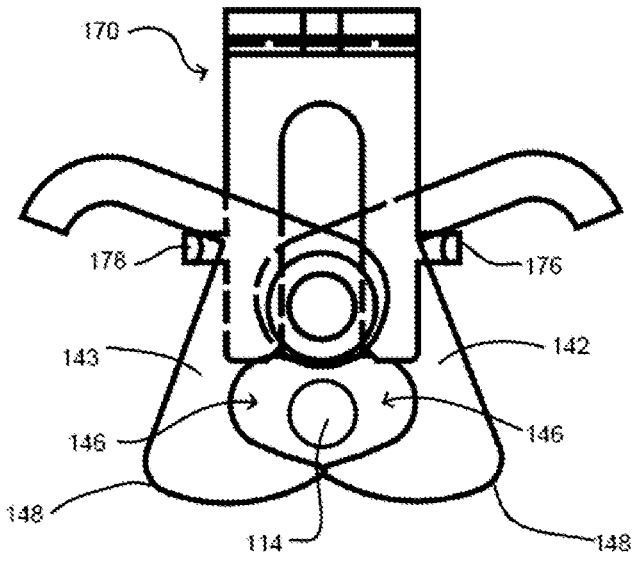
FIG. 9 shows the latch members of the lock system of FIGS. 4 and 5 as the lid is closing when the container is in an upright position.
Figure 10:
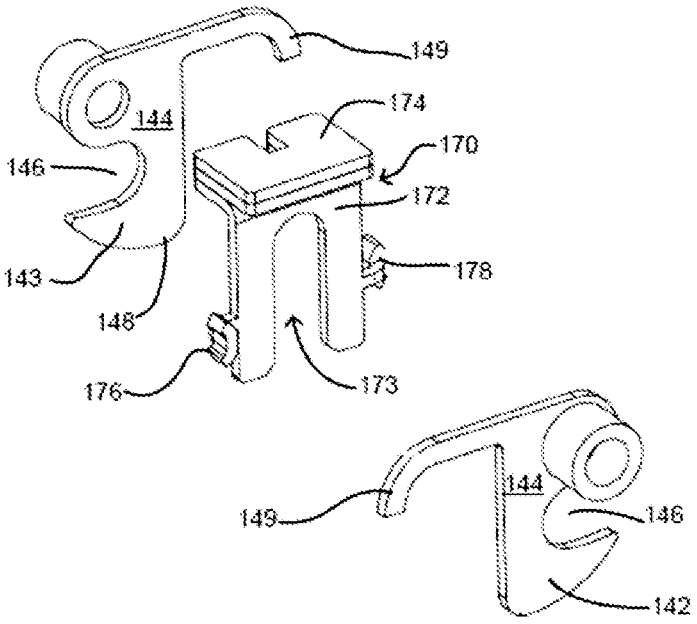
FIG. 10 shows an exploded view of the latch members and the limiter of the lock system of FIGS. 4 and 5 in isolation.

The limiter 170 comprises a body 172 having a slot 173 (as shown in FIG. 8) defined therein, and a weight 174 on the "top" (when container 100 is upright and the lid 130 is closed) thereof. In the illustrated examples, the weight 174 is shown as coupled to the body 172 but it is to be understood that the weight could be integrally formed with the body 172 in other embodiments. The slot 173 is sized slightly larger than the diameter of the pivot pin 134, such that the limiter slides freely along the pivot pin 134. First and second arms 176 and 178 are fixedly connected to opposed sides of the limiter body 172 and configured to engage the first and second latch members 142 and 143 as the limiter 170 slides freely along the pivot pin 134. In some embodiments, first and second arms 176 and 178 may each have a simplified configuration as shown in FIG. 9. In other embodiments, the first and second arms 176 and 178 may each have a curved flange configuration as shown in FIGS. 5, 6, 7 and 9. In particular, one of the first and second arms 176/178 extends in one direction from a plane defined by the body 172 of the limiter 170 and the other of the first and second arms 176/178 extends in the opposite direction from the plan of the body 172 of the limiter 170. In the illustrated examples, arm 178 extends in the direction toward latch member 143, and arm 176 extends in the direction toward latch member 142.

Referring to FIG. 6, when the container 100 is upright, gravity urges the latch members 142 and 143 into engagement with the lock pin 114 and the limiter 170 in a downward position whereby the limiter arms 176 and 178 prevent the latch members 142 and 143 from pivoting and disengagement from the lock pin 114 and the lid 130 is prevented from opening. In particular, each arm 176/178 is positioned adjacent to the side of the body 144 of the respective latch member 143/142 opposite the recess 146. When the container 100 is tipped to either the left or the right side (e.g. the container is pivoted about a horizontal axis generally parallel to the pivot pin 134 and the lock pin 114), the limiter arms 176 and 178 engage and limit the rotation of the latch members 142 and 143 thereby preventing either of the latch members from disengaging the lock pin 114, as shown in FIG. 7. When the container 100 is upside down, as shown in FIG. 8, gravity urges the limiter 170 to slide away from the pivot pin 134 and the latch members 142 and 143 to pivot away from the lock pin 114. As the limiter 170 moves, the limiter arms 176 and 178 strike the protrusions 149 and assist the latch members 142 and 143 from disengaging the lock pin 114.

When the container 100 is tipped forward or backward (e.g. the container is pivoted about a horizontal axis generally perpendicular to the pivot pin 134 and the lock pin 114), once the container is tipped to at least a critical angle past horizontal where the force of gravity acting on the limiter 170 and the latch members 142 and 143 is sufficient to overcome friction and cause the limiter to slide away from the pivot pin 134 thereby no longer limiting the pivot of the latch members 142 and 143 by way of the limiter arms 176 and 178 and cause the latch members 142 and 143 to pivot and the limiter arms 176 and 178 engage the protrusions 149 and assist the latch members to pivot, the lid 130 will be free to open. The critical angle is determined centers of gravity of the latch members 142 and 143 and the limiter 170. In some embodiments the center of gravity of the limiter 170 is fixed. In some embodiments, the critical angle at which the lid 130 will open upon forward tipping of the container may be small (e.g., about 5 degrees or less) such that the lid 130 will open just after the container is tipped past horizontal. In other embodiments, the critical angle may be about 20 degrees (i.e., the lid 130 will open when the container 100 is rotated about 110 degrees from its upright position).

Referring again to FIG. 1, the handle assembly 150 comprises a grip 152 pivotally connected to the lid 130 by a handle pivot 154. The lid 130 optionally has a handle recess 138 configured such that the grip 152 does not protrude above the upper profile of the lid 130 when in the rest position. A user may open the lid 130 by pulling up on the grip 152. The user may thus open the lid 130 with a single hand, leaving the other hand free to deposit waste or compost.

Figure 11:
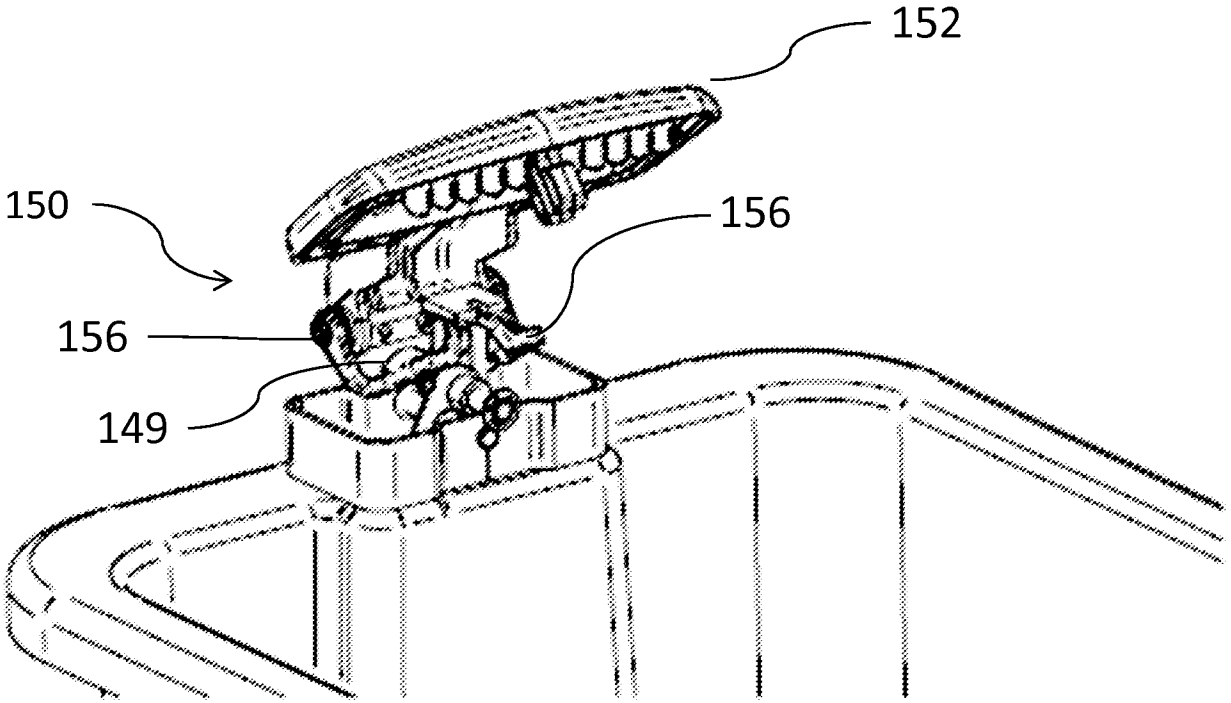
FIG. 11 is a partial perspective view the container body of FIG. 1 shown with the handle, lock mechanism, and features of an example lock system shown in isolation.

As best seen in FIGS. 5 and 11, the handle assembly 150 comprises a pair of arms 156 that move upwardly when the grip 152 is lifted. The arms 156 are configured to contact the protrusions 149 on the latch members 142 and 143 as the arms 156 are lifted, so as to pivot the latch members 142 and 143 out of engagement with the lock pin 114. As the latch members 142 and 143 pivot, they engage the limiter arms 176 and 178 and slide the limiter 170 away from the pivot pin 134. The latch members 142 and 143 are free to rotate independently from the handle assembly 150. Sufficient clearance is provided between the protrusions 149 and the other portions of the latch members 142 and 143 to allow the latch members 142 and 143 to pivot out of engagement with the lock pin 114 under the influence of gravity with the arms 156 in the rest position shown in FIG. 5. As shown in The arms 156 may also be connected by a connecting bar 156A extending between the ends of the arms 156. The connecting bar 156A may be configured to engage the limiter 170 such that when the arms 156 are lifted, the connecting bar 156A pushes and slides the limiter 170 away from the pivot pin 134.

When the container 100 is upright, the lid 130 may be closed either by the user manipulating the handle assembly 150, or in some situations, by simply dropping the lid 130. For closing the lid 130 by manipulating the handle assembly 150, the user pulls up on the grip 152, causing the pair of arms 156 to move upwardly and contact the protrusions 149 on the latch members 142 and 143 so as to pivot the latch members 142 and 143 away from one another, and slide the limiter 170 in an upward position as shown in FIGS. 5 and 11. The user then lowers the lid 130 towards the lock pin 114 until the lock pin 114 is aligned with the recesses 146 of the latch members 142 and 143. To secure the lid 130 in a closed position, the user lowers the grip 152, causing the pair of arms 156 to move downwardly, and gravity urges the latch members 142 and 143 into engagement with the lock pin 114 and the limiter 170 into a downward position.

In some embodiments, the lid 130 may be closed by simply dropping the lid 130, or by "slamming" the lid downward with sufficient force. In such a situation, the bottom surfaces 148 of the latch members 142 and 143 will contact the lock pin 114, as shown in FIG. 9, to pivot the latch members 142 and 143 outwardly, which in turn press against the limiter arms 176 and 178 to lift the limiter 170. Once the notches 146 are aligned with the lock pin 114, gravity pulls the latch members 142 and 143 back into engagement with the lock pin 114 and the limiter 170 slides back down.

Figure 12:
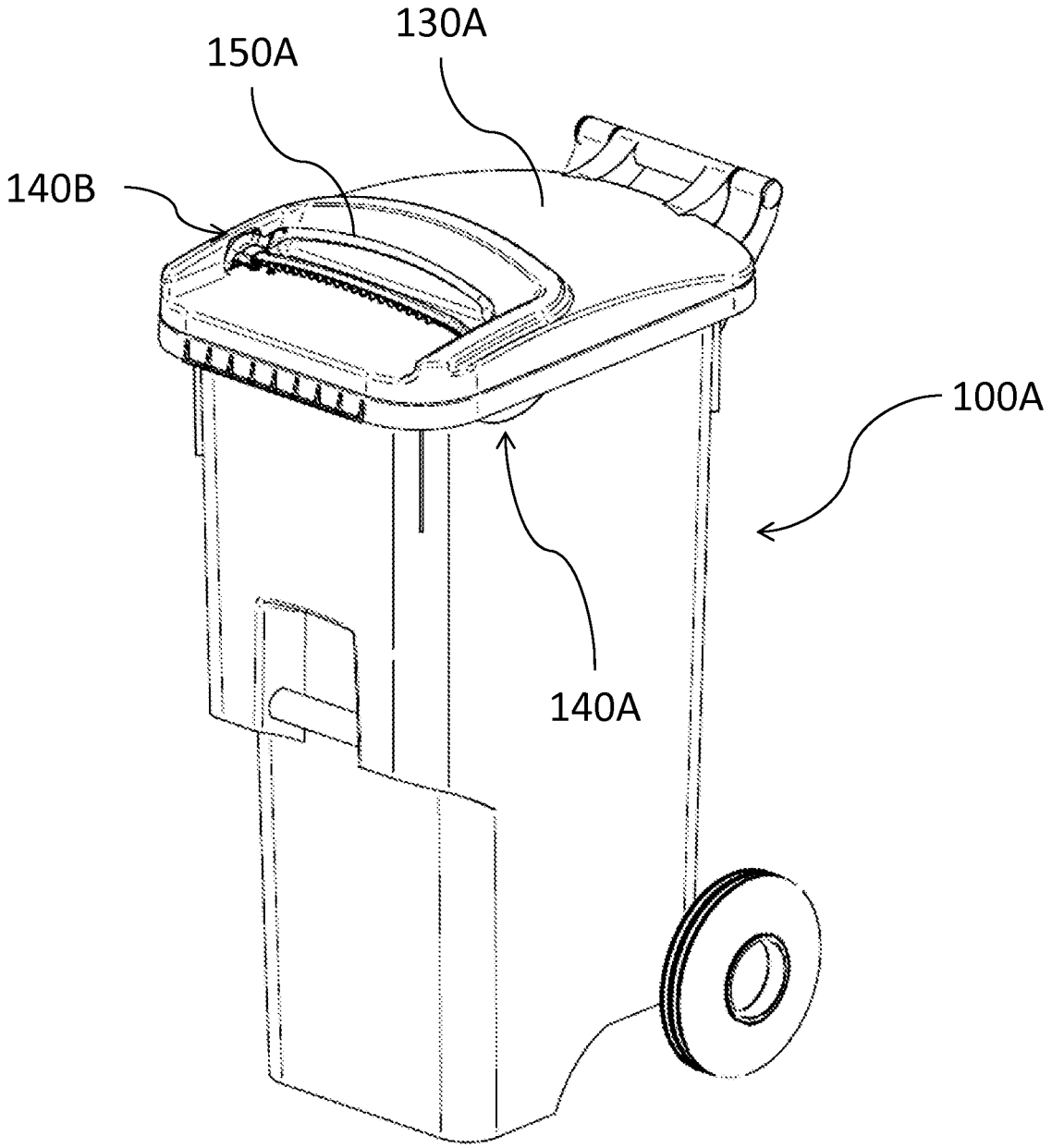
FIG. 12 is a perspective view of the container according to another embodiment.

FIG. 12 shows a container 100A according to another embodiment. Container 100A has two lock systems 140A and 140B disposed on opposing sides of the lid 130A, and a handle assembly 150A configured to manually release both lock systems 140A and 140B, but in other respects is similar to container 100 of FIG. 1.

Figure 13:
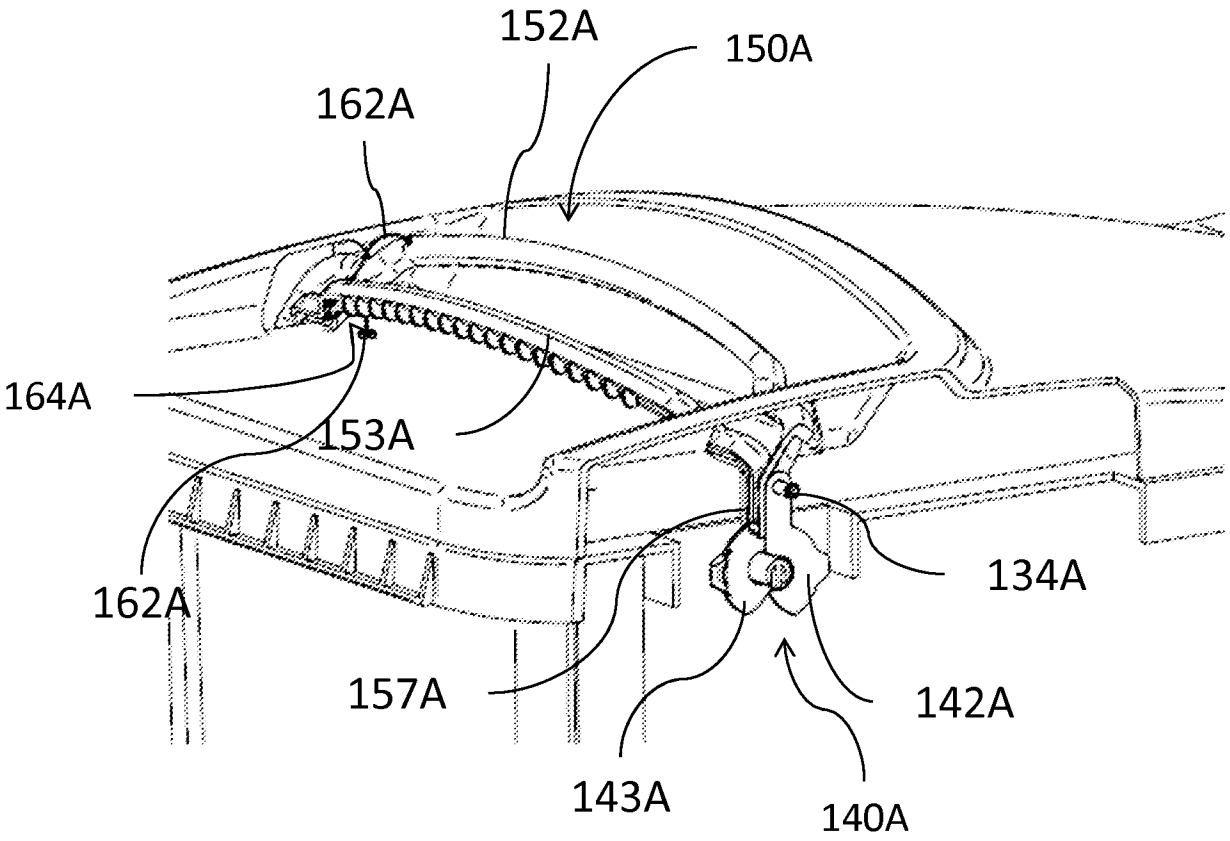
FIG. 13 is a partial perspective view the top of the container of FIG. 12 with portions of the lid and body cut away to show features of another example lock system.

As best seen in FIG. 13, the handle assembly 150A comprises two grips 152A and 153A, which are both pivotally mounted to pivot pins 134A on either side of the container 100A (only one pivot pin 134A is shown in FIG. 13). Each lock system 140A/B comprises latch members 142A/B and 143A/B pivotally mounted to the same pivot pin 134A/B as the grips 152A and 153A. Each grip 152A/153A has a flange 157A configured to engage one of the latch members 142A/B and 143A/B, such that when the grips 152A and 153A are squeezed together, the flanges 157A pivot the latch members 142A/B and 143A/B out of engagement with the lock pins 114A/B. The handle assembly 150A is thus advantageously operable by a single hand, leaving the user's other hand free to deposit waste or compost. The latch members 142A/B and 143A/B are also free to rotate independently of the handle assembly 150A and pivot outwardly to be disengaged from the lock pins 114A/B by gravity, in a manner similar to that described above.

The container 100A also has a safety release mechanism that allows the lid 130A to be opened from the inside, for example if a child is trapped inside the container 100A. The release mechanism comprises a string or cable 162A that is attached to one of the grips 152A and 153A and passes through an aperture in the other of the grips 152A and 153A and then through an aperture 164A in the lid 130A, such that pulling on the string or cable 162A from the interior of the container 100A pulls the grips 152A and 153A together to release the lock systems 140A and 140B.

In another example, not shown, the safety release mechanism may comprise strings or cables attached to the latch members, rather than the grips. In this embodiment, the strings or cables pass through an eyelet or the like on the underside of the lid, and are connected to a pull ring that may be pulled downwardly to pivot the latch members and out of engagement with the lock pin.

Figure 14:
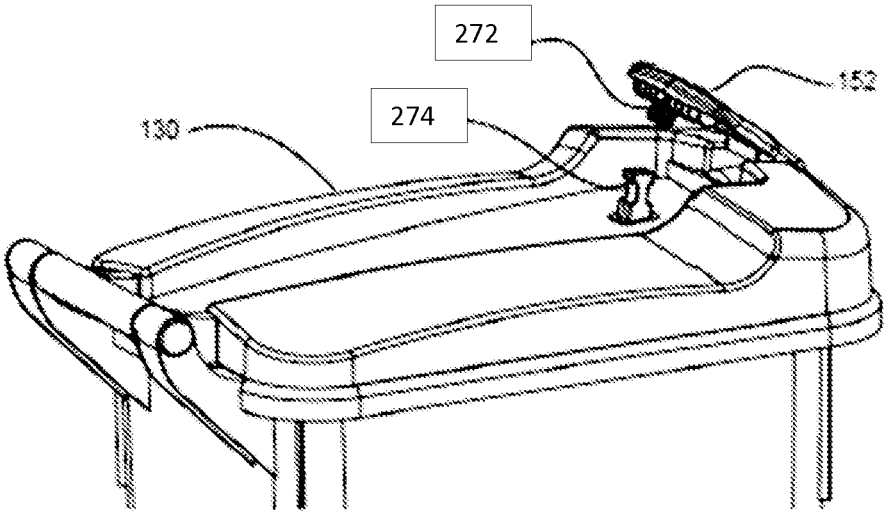
FIG. 14 is a partial perspective view of a container with a dual-action lock system.
Figure 15:
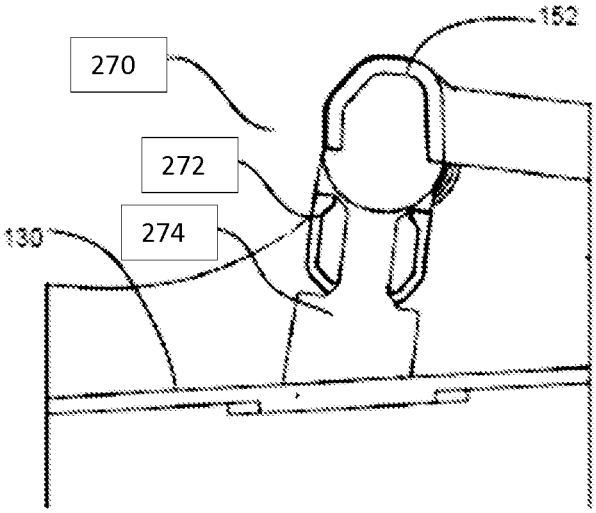
FIG. 15 shows the side of the dual action lock system of FIG. 14.

The container 100 of FIG. 1 may also be provided with a dual-action lock mechanism 270, as shown in FIGS. 14 and 15. The dual-action lock mechanism 270 in this example comprises a first fastener 272 mounted on the grip 152, and a second fastener 274 mounted on the lid 130. This feature can also be seen in FIGS. 5 and 11. The first fastener 272 and the second fastener 274 are generally vertically aligned and designed to engage one another when the lid 130 is in the closed position. When engaged, the dual-action lock mechanism 270 prevents the user from lifting the handle assembly 150. To unlock the dual action lock mechanism 270, the user presses on opposed sides of the first fastener 272, which allows the handle assembly to freely rotate, and pulls the grip 152 to open the lid 130. The dual-action lock mechanism 270, when engaged, prevents pests from lifting the handle assembly 150 to open the lid 130 of the container. While some pests, such as for example raccoons, may be able to lift the grip 152 in the absence of the dual-lock mechanism 270, they lack an opposable thumb with which to press on the opposed sides of the first fastener 272.

In the examples discussed above a handle assembly is provided that allows the container to be opened with a single hand. Such a configuration advantageously allows a user to have a hand free for depositing waste or compost while opening the lid.

A handle assembly is not required in all embodiments. For example, a dumpster type container may have a slot or other secondary opening for depositing materials therein, and the main lid(s) may be secured by one or more lock systems as disclosed herein. Also, a municipal public trash bin or the like may have a lid with one or more relatively small openings for depositing materials and the lid may be secured by one or more lock systems as disclosed herein.

The present disclosure may be embodied in other specific forms without departing from its essential characteristics. The described embodiments are to be considered in all respects only as illustrative and not restrictive. The scope of the claims should not be limited by the example embodiments set forth above, but should be given the broadest interpretation consistent with the description as a whole.

The invention claimed is:

1. A container comprising:

a body having a wall defining an interior and an opening to the interior at a top of the body;

a lid pivotally coupled to the top of the body for selectively covering the opening; and a lock system for selectively securing the lid to the container, the lock system comprising:

a pivot pin mounted to the lid;

a lock pin mounted on the body adjacent to the opening and generally vertically aligned with the pivot pin when the container is upright;

a first latch member pivotally mounted on the pivot pin and configured to engage the lock pin from a first side thereof;

a second latch member pivotally mounted on the pivot pin and configured to engage the lock pin from a second side thereof opposite the first side; and a limiter slidably mounted on the pivot pin between the first and second latch members and configured to engage and control the rotation of the first and second latch members, the limiter weighted such that when the container is upright the limiter is biased by gravity towards the pivot pin when the first and second latch members engage the lock pin to prevent the first and second latch members from disengaging the lock pin;

each of the first and second latch members comprising a latch body having a recess sized to receive the lock pin to prevent opening of the lid when the latch members engage the lock pin, and a bottom surface shaped to pivot each latch member away from the lock pin when each latch body contacts the lock pin as the lid closes.

2. A container according to claim 1 wherein the lid is pivotally coupled to the body at a back of the container and the pivot pin and the lock pin are oriented along a front-back direction with respect to the container, such that a critical angle past horizontal at which gravity pulls the limiter away from the pivot pin and the latch members out of engagement with the lock pin is lesser for forward or backward tilting as compared to leftward or rightward tipping.

3. A container according to claim 1 further comprising a handle assembly operable to selectively disengage the latch members from the lock pin, wherein the latch members are free to rotate about the pivot pin independent of the handle assembly.

4. A container according to claim 3 wherein the handle assembly comprises a grip on a top of the lid, the grip pivotally connected to the lid, and a pair of arms connected to the grip, the arms located on an underside of the lid, wherein each of the latch members further comprises a protrusion extending outwardly and configured to be lifted by one of the arms when the grip of the handle assembly is lifted by a user, such that the latch members are pivoted out of engagement with the lock pin when the grip is lifted.

5. A container according to claim 4 wherein the handle assembly further comprises a dual action lock mechanism comprising:

a first fastener connected to the handle assembly; and a second fastener connected to the lid, wherein the first fastener and the second fastener are generally vertically aligned and designed to engage one another, and when engaged, prevent lifting of the handle assembly.

6. A container according to claim 3 wherein the handle assembly comprises a pair of grips on a top of the lid, the grips pivotally connected to the lid, each grip of the pair having a flange coupled thereto configured to engage one of the latch members, such that the latch members are pivoted out of engagement with the lock pin when the grips are squeezed together.

7. A container according to claim 3 further comprising a safety release accessible from the interior of the container, the safety release comprising a pulling member coupled to the underside of the lid, and at least one string, cable, cord, wire or other connecting member connecting the pulling member to the latch members or the handle assembly.

* * * * *